US005127858A

United States Patent [19]

Pelligrino et al.

[11] Patent Number: 5,127,858

[45] Date of Patent: Jul. 7, 1992

[54] CONTROL MEANS FOR MARINE ENGINES AND TRANSMISSIONS

[75] Inventors: Paul A. Pelligrino; Gary L. Potter; Robert N. Schenk, all of Rockford, Ill.

[73] Assignee: Twin Disc Incorporated, Racine, Wis.

[21] Appl. No.: 730,639

[22] Filed: Jul. 16, 1991

[51] Int. Cl.[5] ..... B63H 21/21; B63H 21/22; B60K 41/00; G06F 15/50

[52] U.S. Cl. ..... 440/84; 440/86; 440/87; 440/2; 364/424.1

[58] Field of Search ..... 440/84–87, 440/2; 364/424.1, 431.05; 180/306; 244/223, 189; 192/0.098, 0.073, 3.56, 4 R

[56] References Cited

U.S. PATENT DOCUMENTS 4,753,618 6/1988 Entringer ..... 440/86
4,759,731 7/1988 Uchida et al. ..... 440/87
4,836,809 6/1989 Pelligrino ..... 440/2

*Primary Examiner*—Joseph F. Peters, Jr.
*Assistant Examiner*—Kenneth Lee
*Attorney, Agent, or Firm*—Nilles & Nilles

[57] ABSTRACT

A marine vessel propulsion system includes one or more drive systems, each including an engine, an engine throttle, and a shiftable transmission. A control system for each drive system comprises a manually operable control lever assembly for electrically operating a servo assembly which mechanically operates the engine throttle and the transmission shifting clutches. The control lever assembly comprises a one-piece plastic support base which is adapted to pivotally support one or two identical one-piece plastic control levers. Components associated with a control lever are interchangeable and identical and include a potentiometer mechanically interconnected between the control lever and the base, a detent plate and a detent arm. The control lever assembly also comprises based-mounted components including a station selector switch, a mode selector switch, an electrical connector and a flexible circuit board for electrically connecting the potentiometer selector switches and electrical connector. The servo assembly comprises a plastic housing containing two identical servo units for mechanically operating the engine throttle and the transmission shifting clutches. Each servo unit comprises a support frame on which are mounted a reversible electric motor having a rotatable motor shaft, a rotatable link-drive shaft and a solenoid-operated clutch for connecting and disconnecting the motor shaft and the link-drive shaft. A potentiometer mechanically connected to the link-drive shaft is restrained from rotation by a clamp engaged with the motor housing.

10 Claims, 12 Drawing Sheets

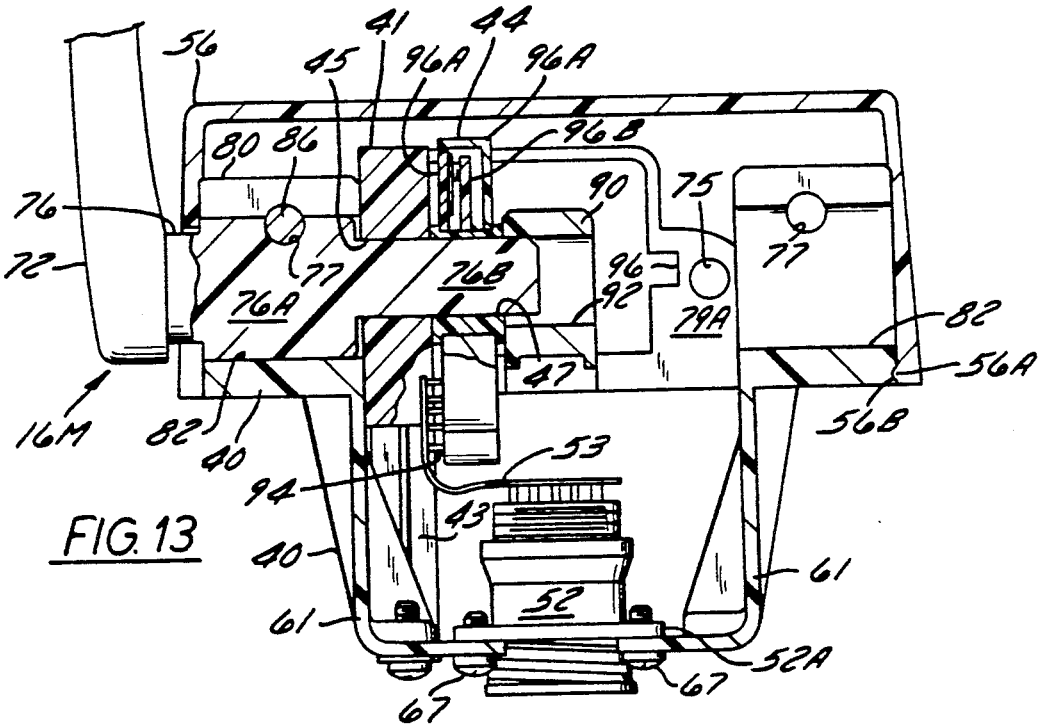
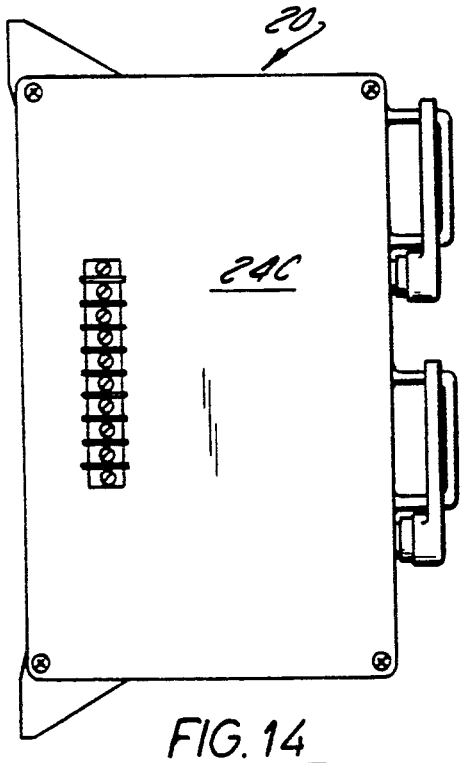
FIG. 14
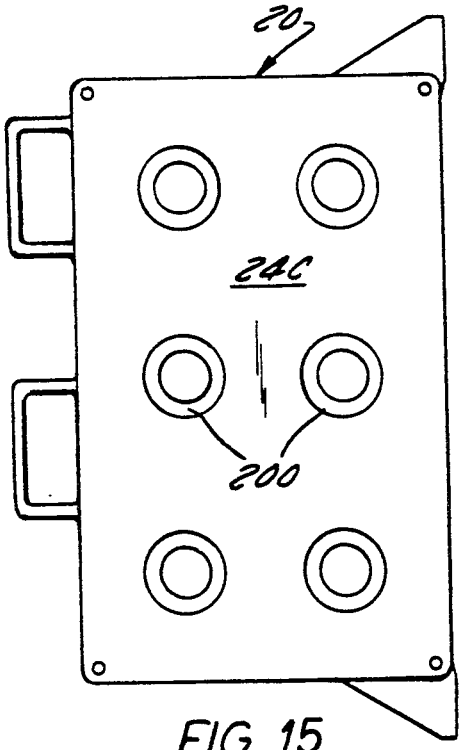
FIG. 15

CONTROL MEANS FOR MARINE ENGINES AND TRANSMISSIONS

BACKGROUND OF THE INVENTION

1. Field of Use

This invention relates generally to control means for marine engines and transmissions.

In particular it relates to improved control lever assemblies and improved servo assemblies for such control means.

2. Description of the Prior Art

U.S. Pat. No. 4,836,809 issued Jun. 6, 1989 and assigned to the same assignee as the present application discloses control means for marine propulsion systems. That patent discloses control means which are adapted for a marine propulsion system which includes either a single engine and its associated shiftable transmission or port and starboard engines and their respective associated shiftable transmissions. That patent discloses control means including one or more alternately usable separate control stations for operating the engine throttle and transmission clutches to control vessel speed and direction. Each control station includes at least one manually operable pivotally movable control lever and a manually operable selector switch which are employed to provide electric signals to an electronic controller (40 or 42) which, in turn, provided appropriate electronic control signals to electric solenoids mounted on the engine throttle and on the clutch control for the transmission clutches. In that patent, the electronics are relatively complex and costly to manufacture and service. Furthermore, the mechanical construction of the control lever assembly at a control station, although very reliable, is costly to manufacture. It is desirable, therefore, to provide improved control means which overcome the afore-mentioned problems but provide the same operational results for vessel control as disclosed in that patent.

SUMMARY OF THE PRESENT INVENTION

The present invention provides control means including improved control lever assemblies and improved servo assemblies which are usable in a marine vessel propulsion system which includes one or more drive systems, each drive system including an engine, a mechanically operable engine throttle (including a pivotally movable throttle lever), a shiftable power transmission, and a mechanically operable transmission clutch assembly (including a pivotally movable shift lever) to effect shifting of the transmission.

Three different propulsion systems and control arrangements are disclosed and claimed herein. The first includes one drive system, one servo assembly and one control lever assembly. The second includes two drives systems (port and starboard), two servo assemblies (port and starboard) and one control lever assembly. The third includes two drive systems (port and starboard), two servo assemblies (port and starboard) and two control lever assemblies (station #1 and station #2).

Each servo assembly comprises a plastic housing in which two identical servo units are mounted, one unit to operate a throttle lever by means of a cable and the other unit to operate a shift lever by means of a cable. Each servo unit comprises a support frame, a reversible electric motor having a stationary housing secured to the frame and a rotatable motor shaft, a link drive shaft rotatably mounted on the frame, a speed-reduction gear train between the motor shaft and the link drive shaft, a solenoid-operated clutch in the gear train for connecting and disconnecting the link drive shaft from the motor shaft, a potentiometer having a body portion and a relatively rotatable potentiometer shaft connected to the link drive shaft, and a mounting clip for mechanically securing the body portion of the potentiometer to the motor housing. Electrical connectors are provided on the housing to enable one or more control lever assemblies to be connected by electric cables to the servo assembly and, furthermore, to enable a power supply battery and other control switches and relays to be connected by other electric cables to the servo assembly.

Each control lever assembly comprises a one-piece plastic support base, at least one manually-operable one-piece plastic control lever pivotally mounted on the base, at least one potentiometer mechanically interconnected between the base and an associated control lever to provide electric control signals to operate a servo assembly, a station selector switch mounted on the base, a mode selector switch mounted on the base, a electrical connector mounted on the base, and a flexible circuit board for electrically connecting the potentiometer and switches to the connector.

In operation, each drive system can be started, controlled and stopped by a control lever assembly at a selected operating station aboard the vessel.

The present invention provides several important advantages over the prior art. For example, the base and control lever in the control lever assembly are each formed as a one-piece plastic member, instead of much more expensive metals, such as bronze, which are traditionally used in marine equipment. Furthermore, the base is configured to support either one or two control levers, depending on system requirements, and the two control levers are identical in configuration and interchangeable. The control lever is secured to the base by a single bolt. The potentiometer, comprising two relatively movable parts, is mounted on the control lever for operation thereby and the stationary portion thereof is prevented from rotating by means of a plastic bolt which frictionally engages s slot formed in the base. The use of a flexible circuit board to make electrical connections within the control lever assembly eliminates the need for elaborate, labor-intensive conventional wiring. The design of the control lever assembly is such that it employs a minimum number of low-cost corrosion-resistant components, most of which are interchangeable, which can be easily and rapidly assembled and disassembled, thereby substantially reducing costs and labor in manufacturing and servicing and increasing the useful life and reliability of the control lever assembly. The servo assembly employs a protective plastic housing and each of the two servo units therewith are identically configured and interchangeable. The servo unit employs a simple and reliable solenoid-operated clutch. The potentiometer in the servo unit is a custom rotation angle component which mounts directly on the link drive shaft and has its body restrained from rotation by a novel, simple, low-cost wire clip which engages a portion of the potentiometer and snaps around the motor housing. Other objects and advantages of the invention will hereinafter appear.

DESCRIPTION OF THE DRAWINGS

FIG. 13 is an enlarged cross-section view of the single lever control assembly shown in FIG. 3;

FIGS. 14 and 15 are left and right side elevation views of a servo assembly shown in FIGS. 1,2 and 3;

DESCRIPTION OF PREFERRED EMBODIMENTS

General Arrangements

Figure 1:
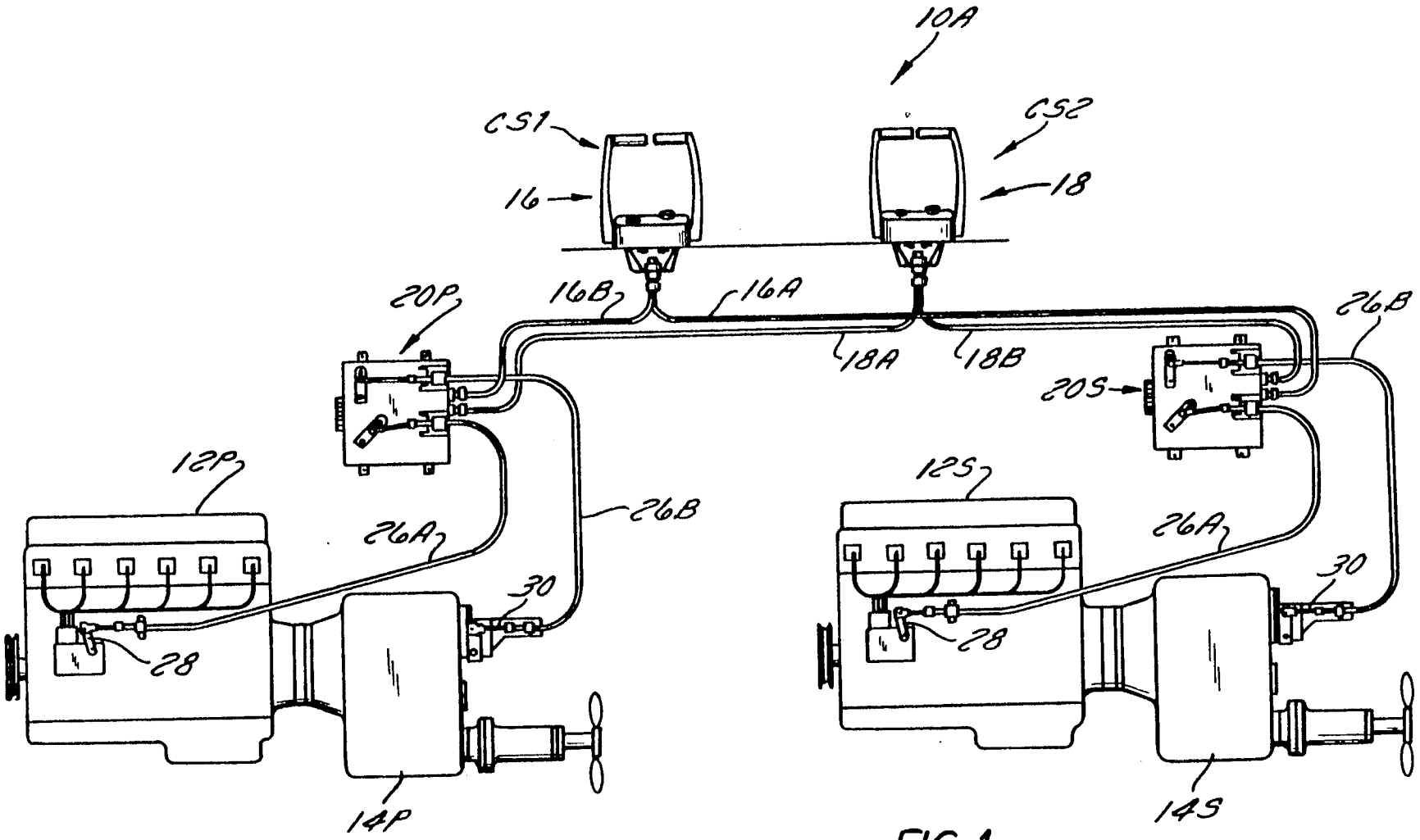
FIG. 1 is a schematic diagram of a first embodiment of a marine propulsion system having two engines employing control devices in accordance with the present invention, including two control lever assemblies and two servo assemblies.
Figure 2:
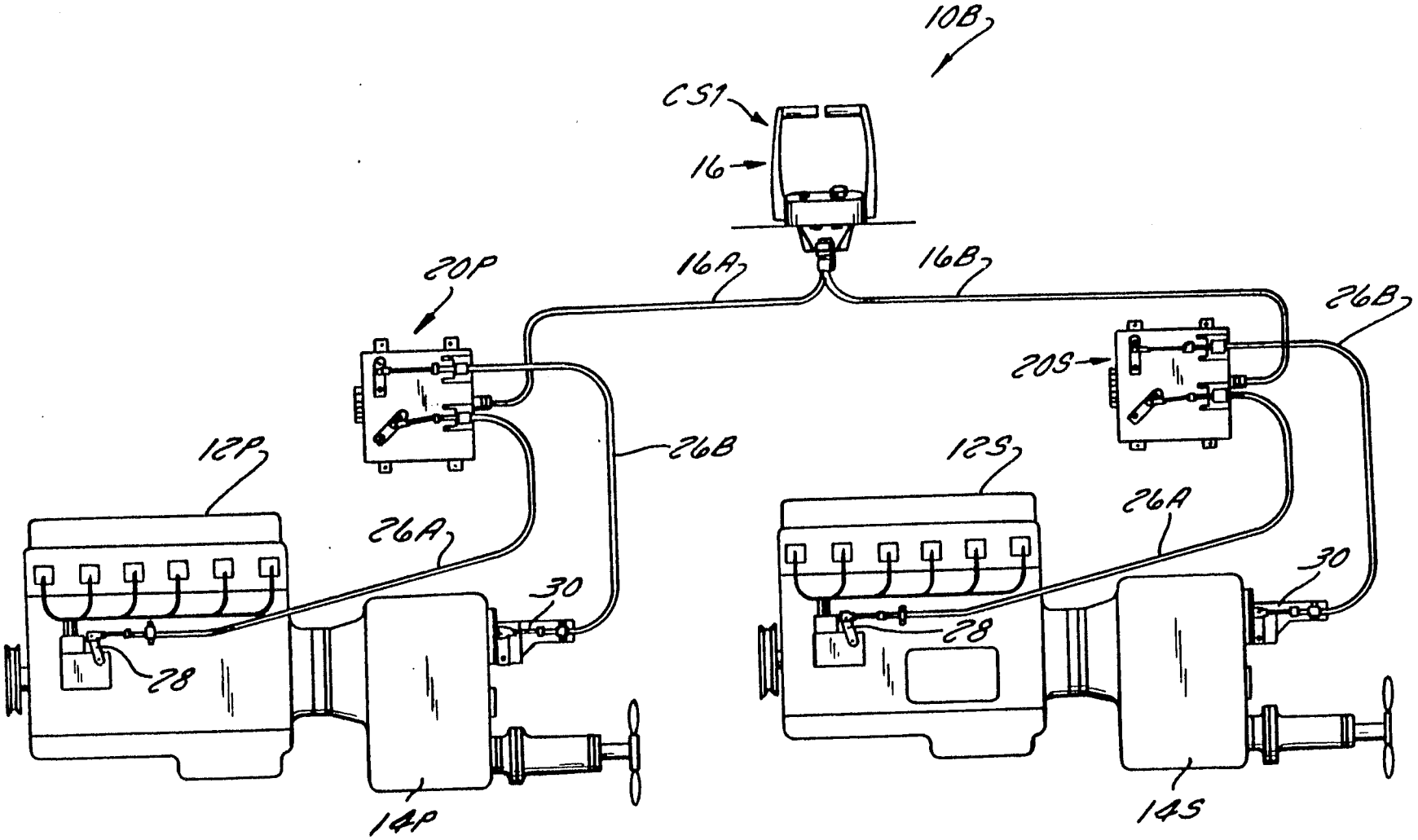
FIG. 2 is a schematic diagram of a second embodiment having two engines, a single control lever assembly and two servo assemblies.
Figure 3:
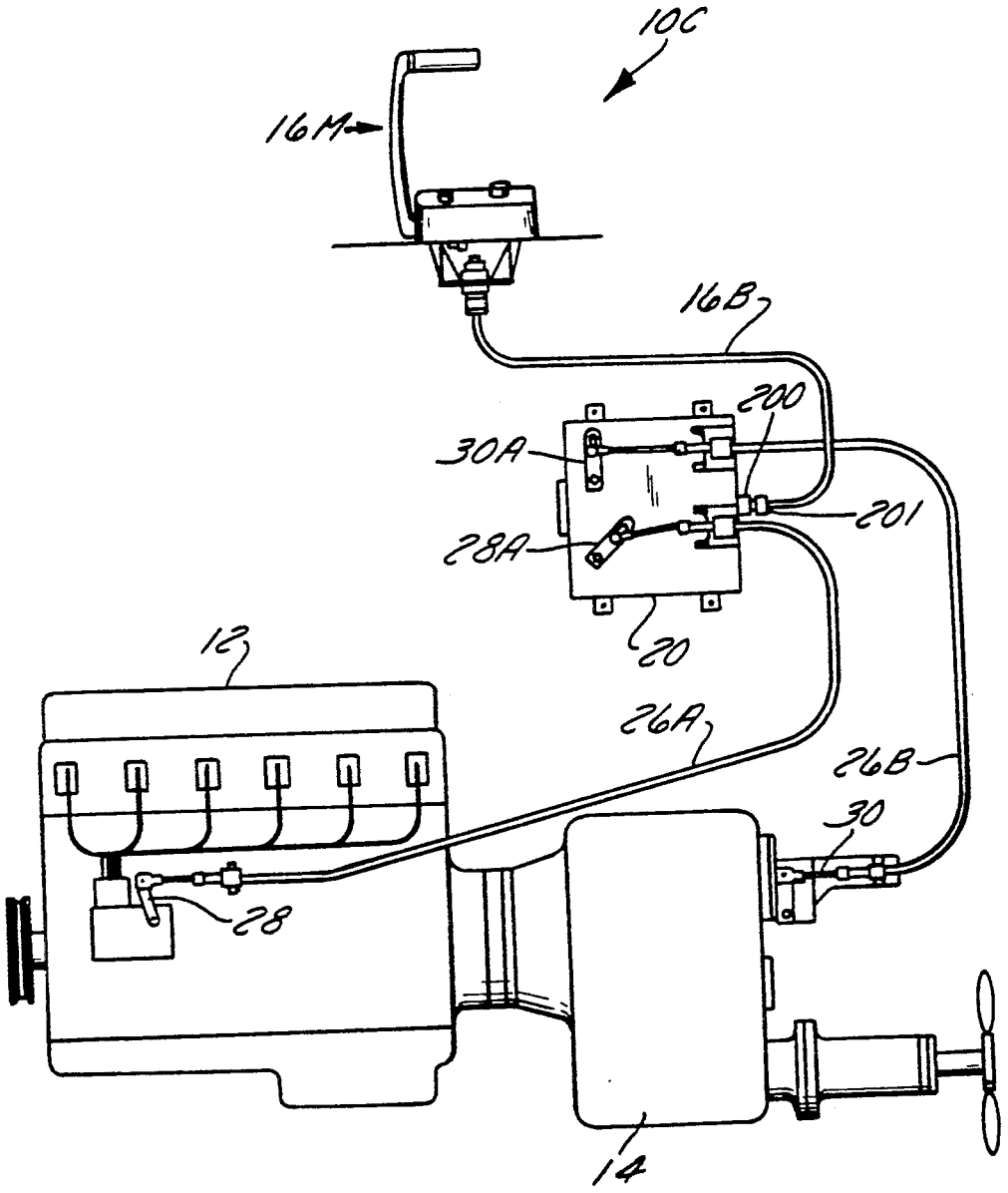
FIG. 3 is a schematic diagram of a third embodiment having a single engine, a single control lever assembly and a single servo assembly.
Figure 5:
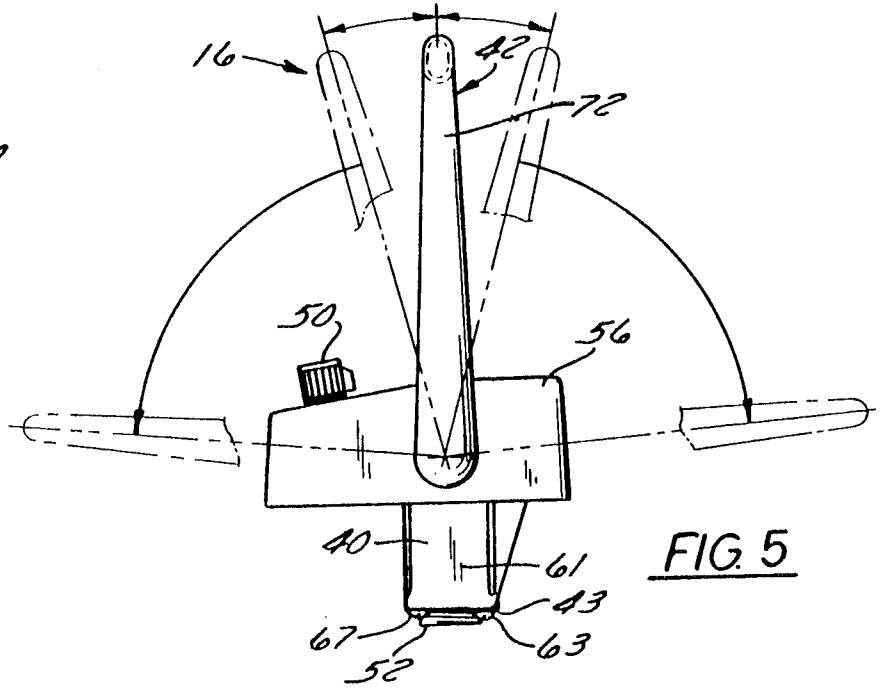
FIGS. 4,5,6 and 7 are elevation views of the rear, starboard, bottom and top sides, respectively, of the control lever assembly shown in FIGS. 1 and 2.
Figure 4:
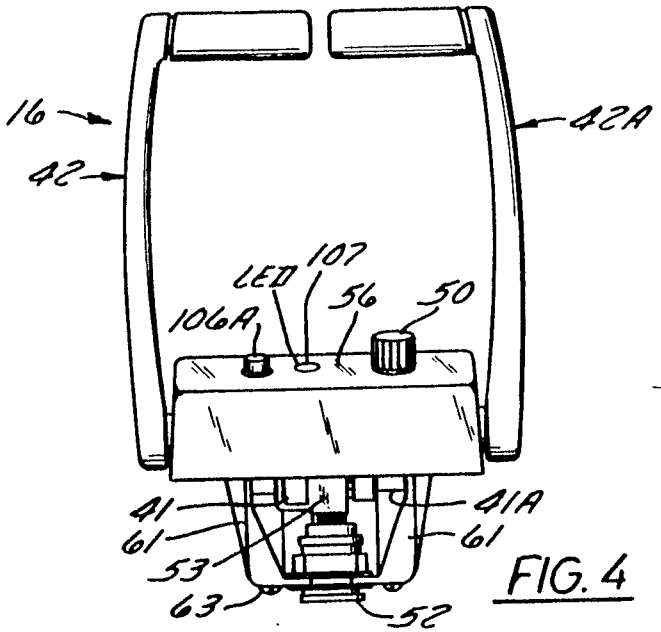

FIGS. 1, 2 and 3 depict three different embodiments, designated 10A,10B and 10C, respectively, of marine propulsion systems employing control means in accordance with the present invention.

Embodiment 10A of FIG. 1 employs a port engine 12P having a shiftable transmission 14P, a starboard engine 12S having a shiftable transmission 14S, a control lever assembly 16 at a control station CS1, a control lever assembly 18 at a.control station CS2, a port servo assembly 20P, and a starboard servo assembly 20S.

Embodiment 10B of FIG. 2 employs a port engine 12P having a shiftable transmission 14P, a starboard engine 12S having a shiftable transmission 14S, a control lever assembly 16 at a control station CS1, a port servo assembly 20P, and a starboard servo assembly 20S.

Embodiment 10C of FIG. 3 employs a single engine 12 having a shiftable transmission 14, a single modified control lever assembly 16M at a control station S1, and a single servo assembly 20.

The several engines identified above are identical to each other. The several transmissions identified above are identical to each other. The several servo assemblies identified above are identical to each other. The several control lever assemblies identified above are identical to each other, except that control lever 16M in FIG. 3 is modified, as hereinafter explained.

Figure 16:
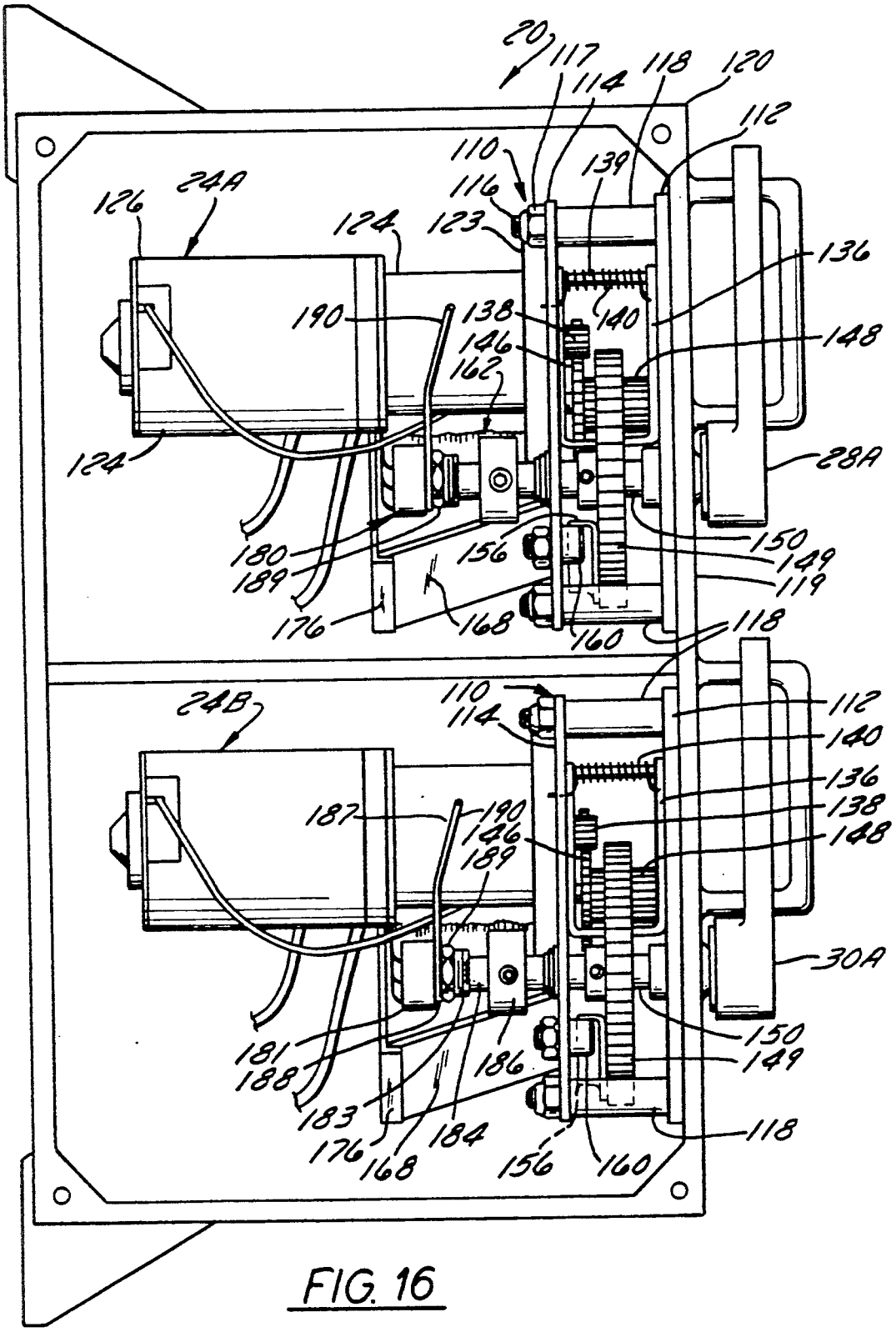
FIG. 16 is an enlarged side elevation view of the servo assembly of FIG. 15 with the side wall removed to show interior details, particularly, two identical servo units.
Figure 17:
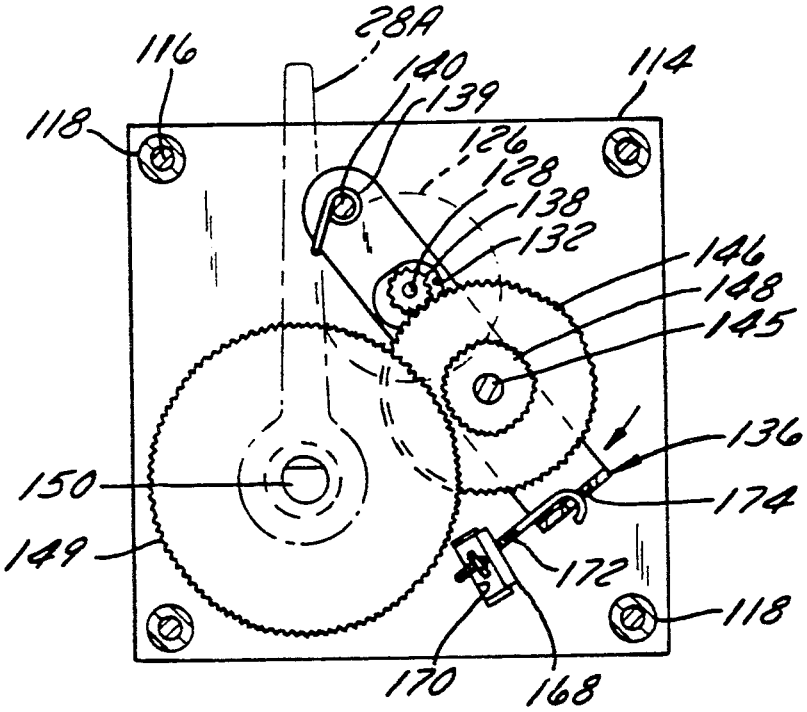
FIGS. 17,18,19 and 20 are front, rear, top and bottom elevation views of one servo unit shown in FIG. 16.
Figure 18:
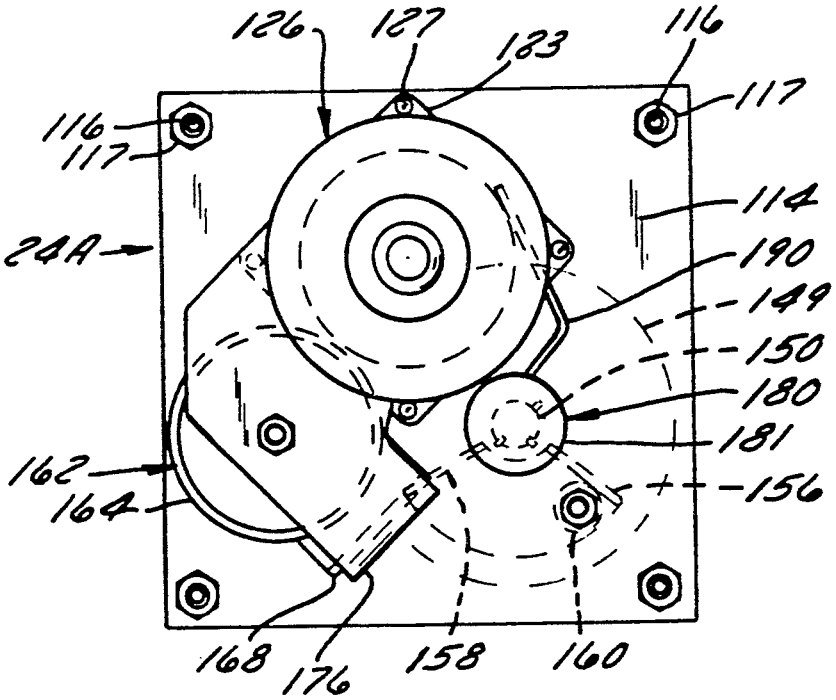
Figure 19:
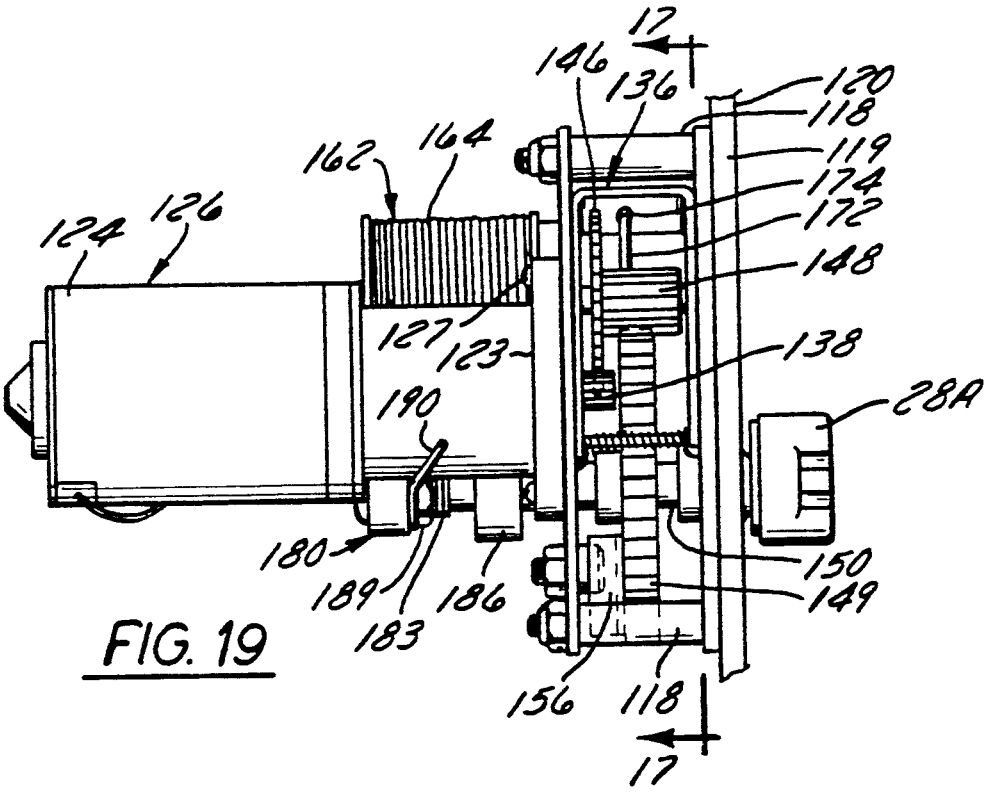
Figure 20:
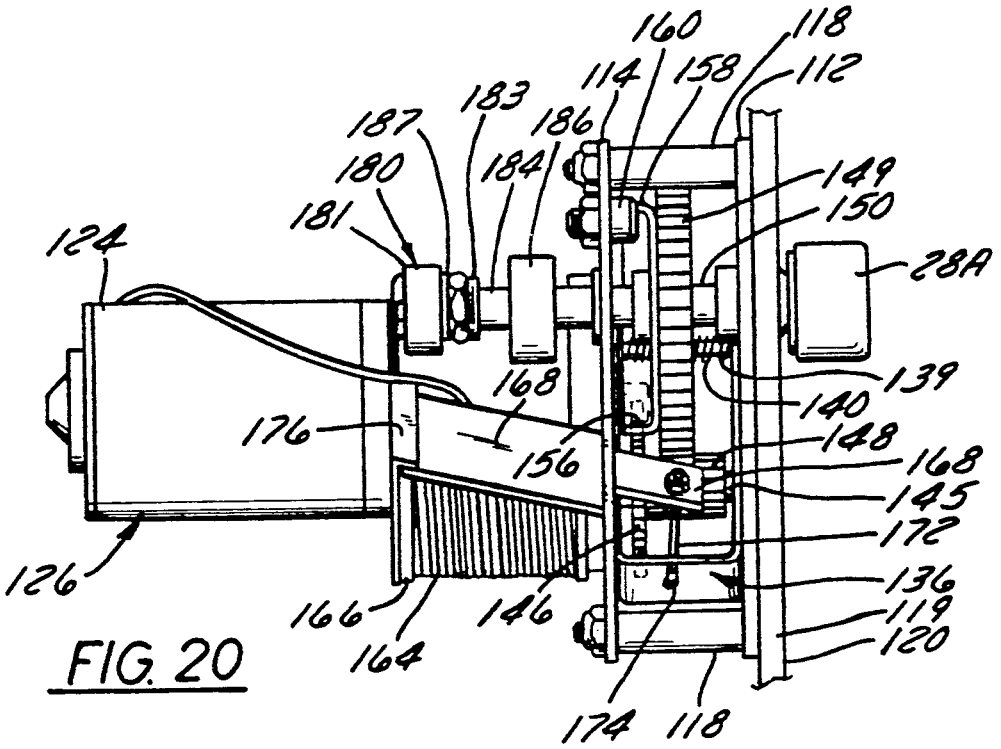

As FIG. 16 shows, each of the above-identified servo assemblies 20S and 20P comprises two identical servo units designated 24A and 24B which, as FIGS. 1,2 and 3 show, are mechanically connected by push/pull cables 26A and 26B, respectively, to operate respectively a pivotally movable engine throttle lever or member 28 on its associated engine to control engine speed and a pivotally movable shift lever or member 30 on an associated transmission to effect shifting of the transmission in a known manner.

The several control lever assemblies 16,16A and 18 are electrically connected by multi-conductor electrical cables to the servo assemblies as follows. In FIG. 1 control lever assembly 16 is connected by cables 16A and 16B to servo assemblies 20P and 20S, respectively. In FIG. 1 control lever assembly 18 is connected by cables 18A and 18B to servo assemblies 20P and 20S, respectively. In FIG. 2 control lever assembly 16 is connected by cables 16A and 16B to servo assemblies 20P and 20S, respectively. In FIG. 3 control lever assembly 16M is connected by a cable 16B to single servo assembly 20.

In operation, generally speaking, manipulation of a single control lever in a control lever assembly effects control of its associated engine and transmission.

Control Lever Assembly

Referring to FIGS. 4,5,6,7,8,9,10,11 and 12, the control lever assembly 16 will now be described in detail, it being understood that control lever assembly 18 is identical in all respects and that control lever assembly 16A is also identical, except for the differences shown in FIGS. 3 and 13. Control lever assembly 16 generally comprises a one-piece plastic support base 40; two one-piece plastic pivotally movable control levers 42 and 42A which are identical to each other but reversely mounted on the support base 40; identical detent plates or members 41 and 41A mounted on the levers; identical detent arms 43 and 43A mounted on base 40; two potentiometers 44 and 44A which are identical to each other but reversely mounted on the control levers 42 and 42A, respectively, and mechanically engaged with base 40 by a plastic nut/bolt 46 (FIGS. 10 and 12); a manually-operable electric push-button type station selector switch 48 (FIG. 9) mounted on bate 40; a manually-operable electric rotatable mode selector switch 50 (FIGS. 7 and 10) mounted on base 40; a female electrical connector 52 mounted on base 40; an LED indicator light (not visible) mounted on base 40; a flexible circuit board 53 electrically connected to the potentiometers 44 and 44A, switches 48 and 50, the light (not visible) and connector 52; and a protective plastic cover 56 retachably mounted on base 40.

Figure 6:
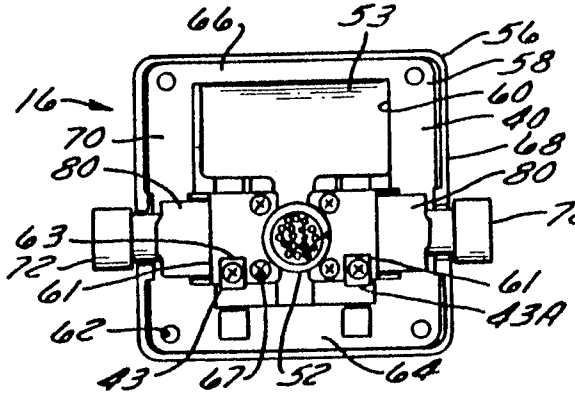

As FIG. 6 shows, base 40 comprises a rectangular planar portion 58 with a relatively large central opening 60 therethrough and with a plurality of mounting holes 62 therethrough which adapt the base for mounting a desired control station CS1 or CS2 on a marine vessel by means of screws or bolts (not shown). Planar portion 5 has a forward portion 64, an aft portion 66, a port sieve portion 68 and a starboard side portion 70.

Figure 7:
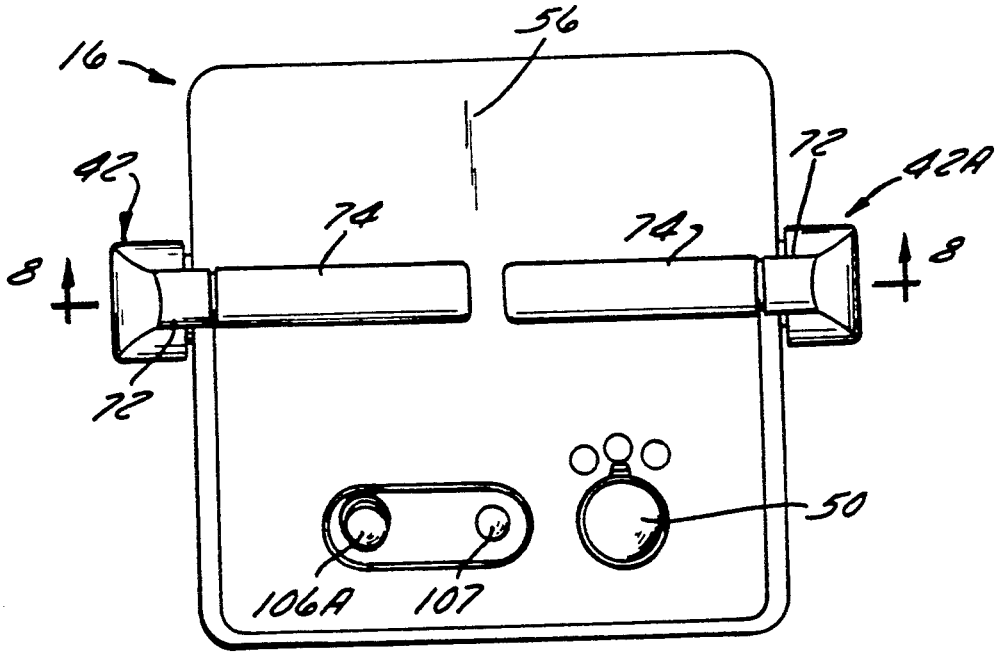
Figure 8:
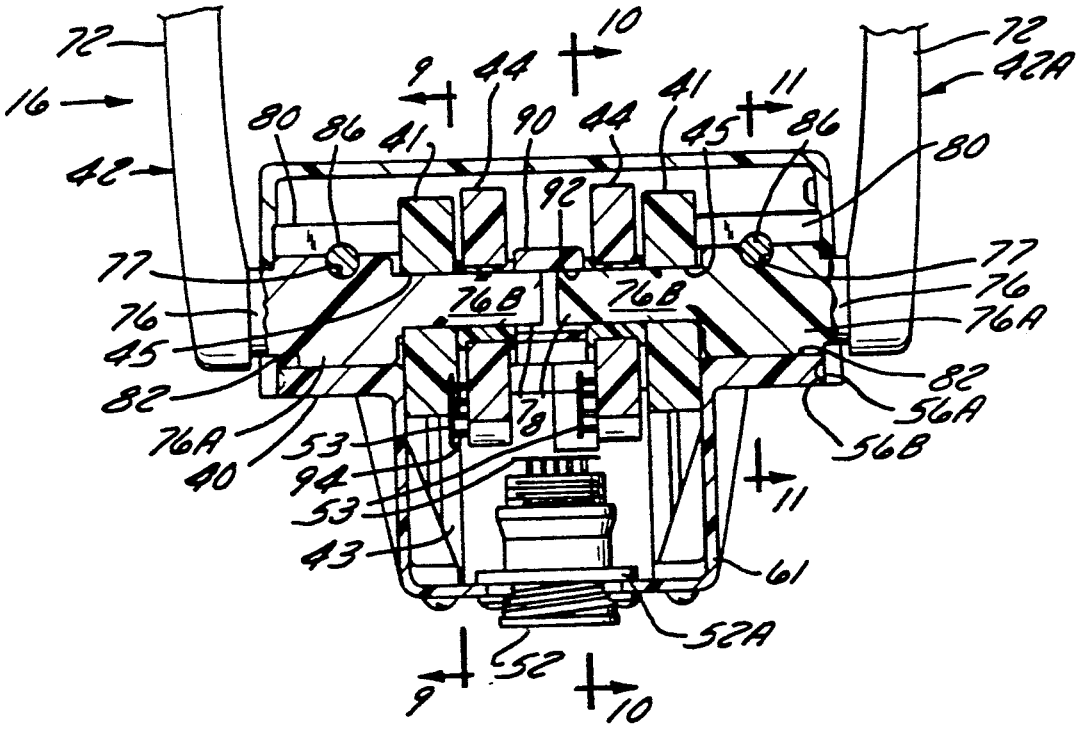
FIGS. 8,9 and 10 are cross-section views taken on lines 8—8, 9—9 and 10—10, respectively, of FIGS. 7 and 8.

As FIGS. 7 and 8 show, each control lever 42,42A comprises an upright portion 72 having a integral handgrip 74 at its upper end and an integral transversely extending control lever shaft 76 at its lower end which includes a large-diameter cylindrical portion 76A with a groove 77 (FIGS. 8 and 11) formed in the periphery thereof and a small-diameter cylindrical portion 76B with flat side 78 (FIGS. 9 and 10) formed at the lower periphery thereof.

Figure 11:
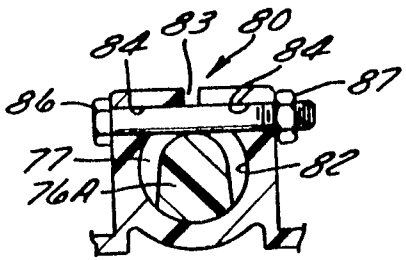

As FIGS. 8 and 11 show, side portions 68 and 70 of base 40 have upwardly-extending identical projections 80 and each is provided with a cylindrical bore 82 for accommodating portion 76A of a control lever 42,42A. Projection 80 has a slot 03 communicating with bore 82 and also has a bolt-receiving hole 84 disposed transversely to and intersecting with bore 82 for accommodating a bolt 86 having a nut 87. Forward portion 64 of base 40 has an integral rearwardly-extending projection 90 (FIG. 8) which is provided with a cylindrical bore 92 for accommodating portion 76B of control levers 42,42A.

During assembly, lever shaft 76 is inserted through bore 82 in projection 80, through a hole 45 in detent plate 41, through a hole 47 in potentiometer 44 and into bore 92 in projection 90. Then, bolt 86 is inserted into bolt-receiving hole 84 and extends through groove 77 in lever shaft 76 to thereby prevent axial movement and withdrawal of the lever shaft. Then, nut 87 is tightened to secure bolt 86 in place and to slightly reduce the width of slot 83 and cause projection 80 to exert a desired amount of friction for resisting pivotal movement of control lever 42,42A during operation to suit the operator's choice.

Figure 9:
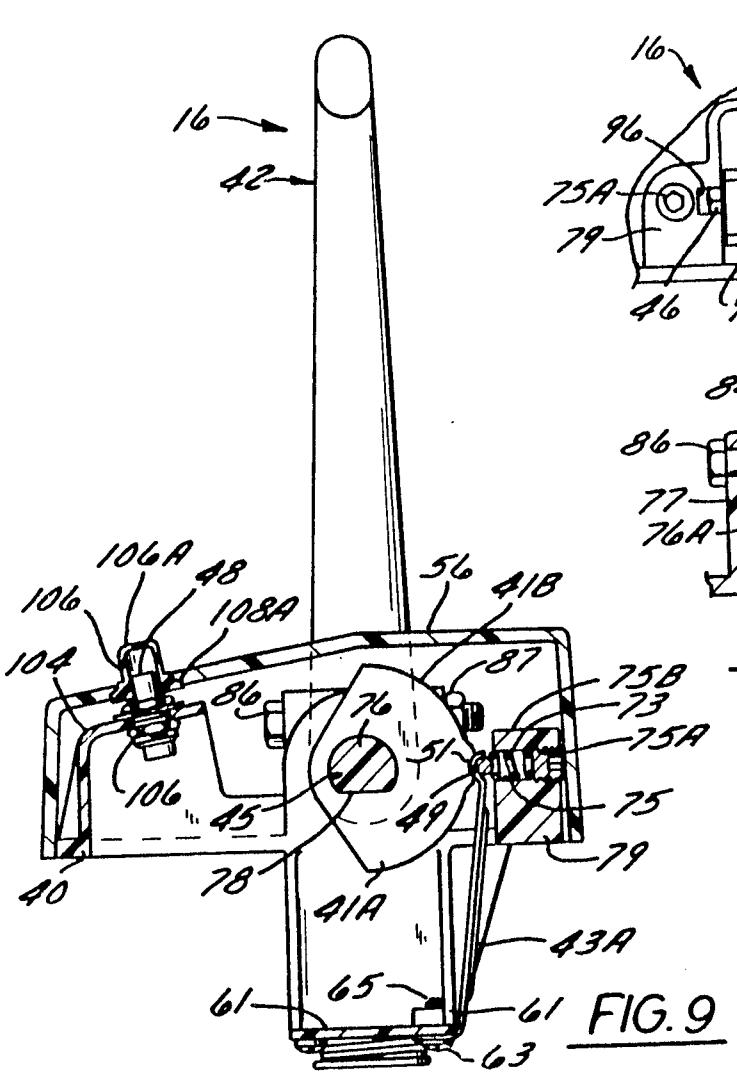

As FIGS. 8 and 9 show, detent plate 41A, which is formed of plastic, is cam-shaped and has a semi-circular peripheral edge or cam surface 41B in which a notch 49 is provided for releasably engaging a detent 51 formed in detent arm 43A. Detent arm 43A is formed of corrosion-resistant, resilient, flexible metal and has its lower end rigidly secured to downwardly-extending identical projections 61 on the underside of side portions 68 and 70 of base 40 by a screw 63 which self-threads into a hole 65 in the base.

Each detent arm 43,43A is biased toward its detent plate 41,41A by means of a helical compression spring 73 (FIG. 9) which is disposed in a bore 75 formed in each projection 79 and 79A (FIG. 12) which are integral with and extend upwardly from forward portion 64 of base 40. Bore 75 is threaded to receive a tension-adjusting screw 75A (FIG. 9) which bears against one end of spring 73. The other end of spring 73 bears against a ball-bearing 75B (FIG. 9) which, in turn, bears against a detent arm 43,43A.

Figure 22:
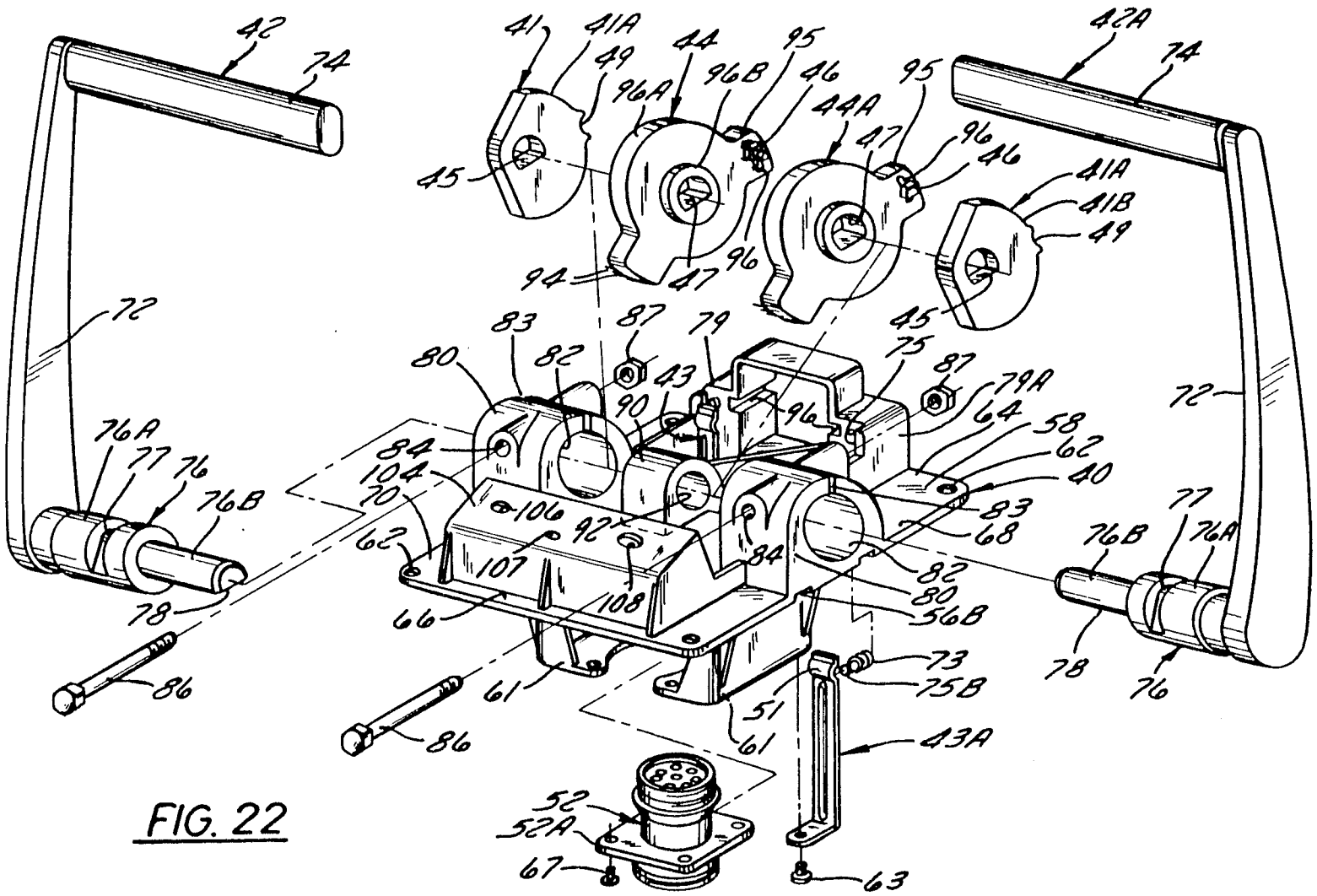
FIG. 22 is an exploded perspective view of a control lever assembly shown in FIGS. 1 and 2 and having two control levers.

The projections 61 on base 40 also provide support for the electrical connector 52 which is secured thereto by four screws 67 which extend through holes 65 (FIG. 22) in the base and self-thread into a flange 52A on connector 52.

Figure 10:
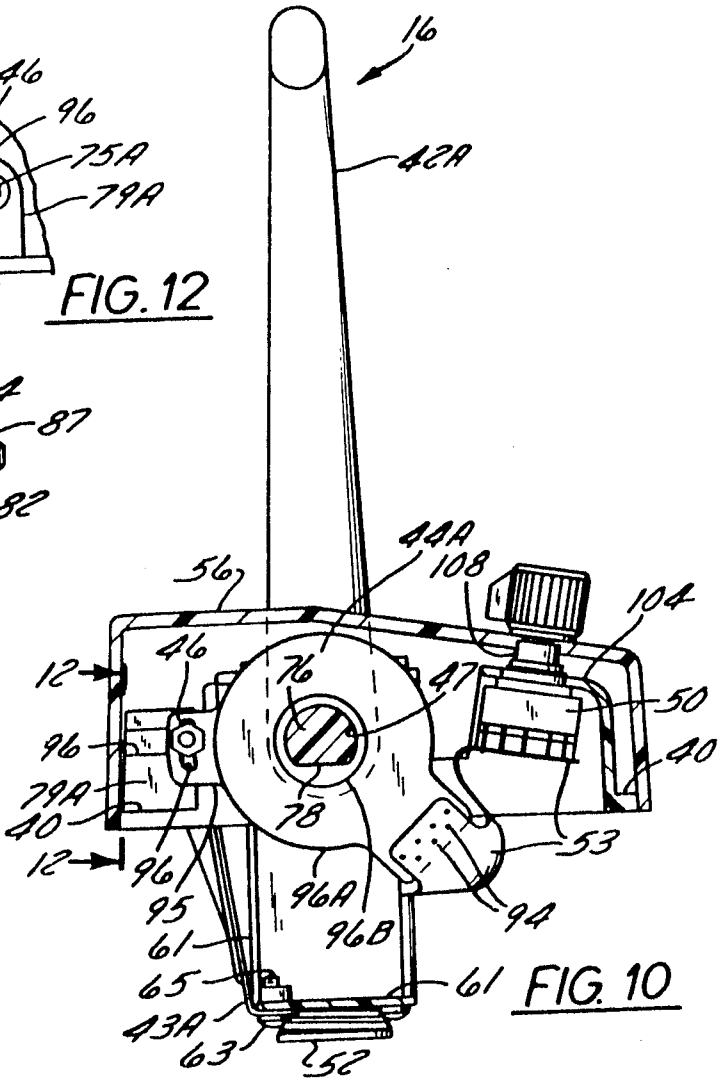
Figure 12:
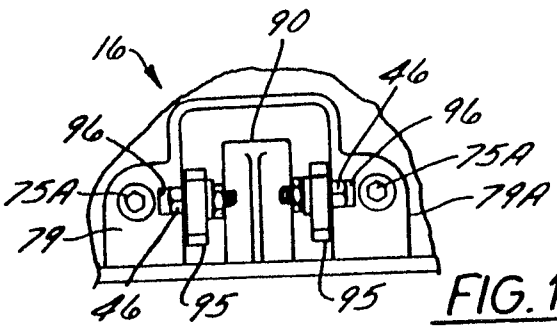
FIGS. 11 and 12 are cross-section and elevation views taken on lines 11—11 and 12—12, respectively, of FIGS. 8 and 10, respectively.

Referring to FIGS. 8,10 and 12, each potentiometer 44, 44A generally takes the form of a flat cylinder having a projection on one side of its periphery at which electric terminals 94 are located. Each potentiometer has another projection 95 which includes a slot 96 for receiving the head of a plastic nut/bolt 46. Each potentiometer, which is a custom designed component, has a housing 96A in which a resistor coil and switch contacts (not shown) are mounted and a relatively rotatable wiper portion 96B having central hole 47 therethrough in which cylindrical portion 76B of the control lever 42 is received. The head of nut/bolt 46 is hexagonal and sized so that it can be slid into a slot 96 formed in an inner edge surface of each projection 79 and 79A during assembly and then tightened. This prevents housing 96A from rotating when control lever 42 is pivotally moved to effect rotation of wiper portion 96B during operation of the control lever assembly 16.

As FIGS. 9 and 10 show, the aft portion 66 of base 40 has a flat ledge 104 projecting thereabove which is provided with three mounting holes (only 106 and 108 visible) in which station selector switch 48, the light (not visible) and mode selector switch 50, respectively, are mounted in a conventional manner.

The electric terminals on the potentiometer 44 and 44A, on the mode selector switch 50 and on the connector 52 are interconnected by flexible circuit board 53 (FIGS. 6,8 and 10).

Protective cover 56 is, as FIG. 8 shows, provided with integrally formed detents 56A (two visible) which releasably engage notches 56B formed in the underside of the outer edges of the side portions 68 and 70 of base 40 to secure the cover to the base. Cover 56 includes a water-tight flexible boot 106A (FIGS. 7 and 9) overlying the depressable pushbutton switch 48 and a translucent water-tight lens 107 overlying the light (not shown). A water-tight seal 108A is provided for hole 106.

As FIGS. 3 and 13 show, control lever assembly 16M is the same as above-described but the control lever 42A and its associated components are omitted.

Servo Assembly

Referring to FIGS. 3 and 14 through 21, servo assembly 20 will now be described in detail, it being understood that it is identical in all respects to the servo assemblies 20P and 20S. Servo assembly 20 comprises two servo units 24A and 24B (FIG. 16) which are identical to each other and, therefore, only servo unit 24A is hereinafter described in detail, unless otherwise noted. Servo unit 24A comprises a support frame 110 which includes a rectangular metal front plate 112 to which a metal rear plate 114 is rigidly secured in spaced-apart relationship by means of four bolts 116 which have tubular metal spacers 118 therearound and engage nuts 117. Front plate 112 is rigidly secured to the front side 119 of a plastic housing 120 by screws (not shown). The flange 123 of cylindrical housing 124 of a reversibly rotatable electric motor 126 is rigidly secured by a plurality of bolts 127 to rear plate 114. The rotatable motor shaft 128 extends through a hole 130 in rear plate 114 and through an enlarged hole 132 in one leg 134 of a U-shaped clutch bracket 136. Motor shaft 128 has a small gear 138 affixed thereto. Clutch bracket 136 is pivotally mounted between the base plates 112 and 114 by means of a pivot pin 140 secured to holes 141A and 141B in the base plates and extending through pin holes 142 in the bracket 136 near the open end thereof. A helical torsion spring 139 around pivot pin 140 and attached at one end to the bracket and at its other end to a hole 144 in rear plate 114 biases clutch bracket 136 to clutch-disengaged position. Clutch bracket 136 rotatably supports on a shaft 145 between its legs a reduction gear assembly comprising a large gear 146 to which a small gear 148 is rigidly secured. Large gear 146 is in constant mesh with gear 138 on motor shaft 128, regardless of the position of clutch bracket 136. Small gear 148 is movable into and out of engagement with a large gear 149 which is fixedly secured to a link drive shaft 150 which is rotatably mounted by means of bearings 152 and 154 which are mounted in holes 153 and 155 in front plate 112 and rear plate 114, respectively, of support frame 110. A throttle lever 28A (or a shift lever 30A) is fixedly secured to link drive shaft 150 exteriorly of housing 120. Large gear 149 is provided on its rear side with a pair of radially spaced apart stops 156 and 158 which cooperate with a stop member 160 disposed therebetween and affixed in arcuate slot 161 in rear plate 114 of support frame 110 to limit the rotational or travel of link drive shaft 150 and the lever 20A (or 30A) driven thereby when the clutch is engaged.

Clutch bracket 136 is pivotally movable between engaged and disengaged position by means of an electric solenoid 162 mounted on the back side of rear plate 114 of support frame 110. Solenoid 162 comprises a wire coil 164 between "D"-shaped pole pieces 165 and wound on a core having a magnetic pole piece 166 and cooperates with a pivotally movable armature 168. Armature 168 is pivotally mounted in a hole 170 in rear plate 114, being secured by a small keeper spring 171, and is mechanically connected to the closed end of clutch bracket 136 by means of a metal hook 172 which is loosely secured in a hole 173 in armature 168 and a hole 174 in clutch bracket 136. Armature 168 is biased to clutch disengaged position against a metal stop member 176 in response to the biasing action of spring 139 for bracket 136.

Figure 21:
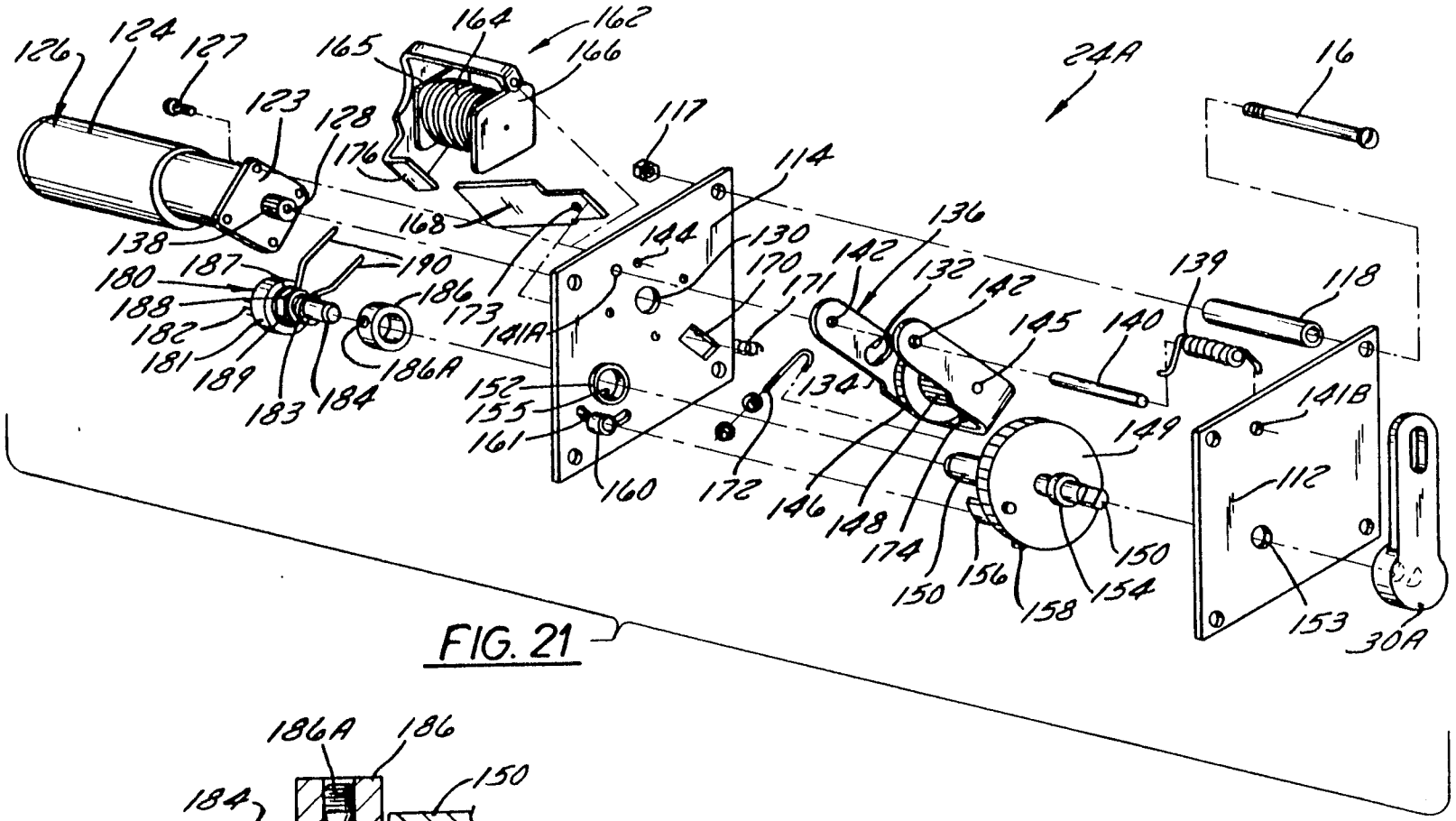
FIG. 21 is an exploded perspective view of the servo unit shown in FIG. 16.
Figure 21A:
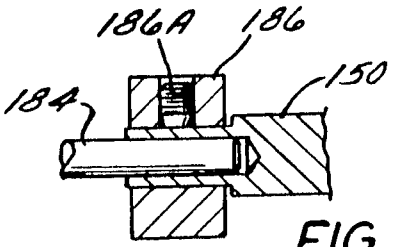
FIG. 21*a* is a cross-sectional, fragmentary view showing the set-screw connection between two shafts.

A custom designed potentiometer 180 having a generally cylindrical housing 181, electric terminals 182, a threaded mounting collar 183 and a rotatable shaft 184 is provided to give electric signal information indicative of the angular position of link drive shaft 150 and the link thereon so that motor 126 can be controlled accordingly. Potentiometer shaft 184 is affixed to and rotatable by link drive shaft 150 by means of a clamping collar 186 (FIG. 21a) which surrounds a diametrically reduced end 150a of shaft 150. More specifically, set screw 186A in collar 186 deforms a thin section of shaft 150 to clamp potentiometer shaft 184 to shaft 150. Means are provided to prevent rotation of potentiometer housing 181 and comprise a generally U-shaped mounting clip 187 which is formed of resilient wire and is bent so that its closed end defines a semi-circular portion 188 which fits around threaded mounting collar 183 and is secured there by a mounting nut 189. The legs 190 of clip 187 are biased toward each other but are spread apart to firmly engage the opposite sides of motor housing 124, thereby preventing rotation of the potentiometer housing 181 and providing further support for the potentiometer itself.

As FIGS. 3 and 15 show, suitable electric connectors 200 and 201 are provided to furnish electric power and signal information to servo unit 24A.

In operation, servo unit 24A responds to appropriate signal information from control lever assembly 16 to energize electric motor 126 to effect rotation of motor shaft 128 in forward or reverse direction and to effect pivotal operation of clutch bracket 136 between engaged and disengaged positions whereby rotation of link drive shaft 150 and lever 28A (or 30A) thereon causes appropriate control of engine 12 and/or transmission 14. Maximum arcuate travel of engine 12 and/or transmission 14. Maximum arcuate travel of lever 28 (or 30A) is limited by the stops 156 and 158. The amount and direction of such arcuate travel is determined by the direction of rotation of motor 126 and the length of time solenoid 162 is energized (i.e., clutch engaged).

We claim:

1. A control system for a marine vessel propulsion system having a movable engine throttle member and a movable transmission shift member, said control system comprising:

a control lever assembly comprising a manually operable pivotally movable control lever and a potentiometer adjacent and mechanically connected to said control lever for providing electric signals in response to operation of said control lever;

a servo assembly comprising two servo units, one servo unit for effecting operation of said engine throttle member and the other servo unit for effecting operation of said transmission shift member;

means for mechanically connecting said one servo unit to said engine throttle member and for mechanically connecting said other servo unit to said transmission shift member;

and means for electrically connecting said potentiometer to both servo units to effect control of said engine throttle member and said transmission shift member.

2. A control system for a marine vessel propulsion system having two engine throttle members and two transmission shift members, said control system comprising:

a control lever assembly comprising two manually operable pivotally movable control levers and two potentiometers adjacent and each potentiometer mechanically connected to a respective control lever for providing electric signals in response to operation of said respective control lever;

two servo assemblies, each servo assembly comprising two servo units, one servo unit for effecting operation of a respective engine throttle member and the other servo unit for effecting operation of a respective transmission shift member;

means for mechanically connecting one servo unit in one servo assembly to a respective engine throttle member and for mechanically connecting said other servo unit in said one servo assembly to a respective transmission shift member;

means for mechanically connecting one servo unit in the other servo assembly to a respective engine throttle member and for mechanically connecting said other servo unit in said other servo assembly to a respective transmission shift member;

and means for electrically connecting each potentiometer to both servo units in a respective servo assembly to effect control of one engine throttle member and one transmission shift member.

3. A control system for a marine vessel propulsion system having two movable engine throttle members and two transmission shift members, said control system comprising:

two control lever assemblies, each control lever assembly comprising two manually operable pivotally movable control levers and two potentiometers adjacent and each potentiometer mechanically connected to a respective control lever for providing electric signals in response to operation of said respective control lever;

two servo assemblies, each servo assembly comprising two servo units, one servo unit for effecting operation of a respective engine throttle member and the other servo unit for effecting operation of a respective transmission shift member;

means for mechanically connecting one servo unit in one servo assembly to a respective engine throttle member and for mechanically connecting said other servo unit in said one servo assembly to a respective transmission shift member;

means for mechanically connecting one servo unit in the other servo assembly to a respective engine throttle member and for mechanically connecting said other servo unit in said other servo assembly to a respective transmission shift member;

and means for electrically connecting one potentiometer in each control lever assembly to both servo units in a respective servo assembly to effect control of one engine throttle member and one transmission shift member.

4. A control system according to claim 1 or 2 or 3 wherein each control lever assembly further comprises a support base on which at least one control lever is pivotally mounted and wherein the associated potentiometer is mechanically connected between said one control lever and said base.

5. A control system according to claim 4 wherein each control lever comprises a shaft and an arm extending transversely from said shaft; wherein each base comprises means for rotatably engaging the shafts of a plurality of control levers; and wherein each potentiometer comprises two relatively rotatable components, one component having an opening for receiving the shaft of an associated control lever being movable thereby and the other component being fixedly engaged with said base.

6. In a control lever assembly for providing electric signals, in combination:

a base having a bore therein;

a potentiometer having a first component and a relatively movable second component, said second component having a bore therethrough;

a pivotally lever arm having a shaft extending transversly therefrom and disposed in said bores, said shaft being rotatably movable in the bore in said base but being non-rotatable in said bore in said second component;

and means for connecting said first component to said base to enable pivotal movement of said lever arm to effect rotation of said second component while said first component remains stationary.

7. A control lever assembly according to claim 6 wherein said base is provided with a hole which transversely intersects said bore in said base, wherein said shaft of said lever arm is provided with a groove in the periphery thereof which registers with the hole in said bate, and further comprising a member inserted in said hole in said base and in said groove to prevent axial movement of said shaft relative to said base.

8. A control lever assembly according to claim 6 or 7 further comprising:

first detent means having a bore therethrough for receiving said shaft so that said first detent means is mounted on and rotatable with said shaft as said lever arm is pivotally moved;

and a second detent means mounted on said base and biased into engagement with said first detent means to releasably maintain said lever arm in a predetermined position.

9. In a servo unit for a servo assembly, in combination:

a base;

a reversible electric motor having a motor housing mounted on said base and having a rotatable motor shaft;

a drive shaft rotatably mounted on said base;

means for selectively connecting and disconnecting said motor shaft from driving engagement with said drive shaft;

a potentiometer for providing electric signals indicative of the angular position of said drive shaft, said potentiometer comprising a potentiometer housing and a potentiometer shaft rotatable relative to said potentiometer housing;

means for connecting said potentiometer shaft to said drive shaft;

and means for fixedly securing said potentiometer housing to said servo unit to prevent rotation of said potentiometer housing as said potentiometer shaft rotates.

10. A servo unit according to claim 9 wherein said potentiometer further comprises a threaded mounting member fixed to said potentiometer housing and having a rotatable nut thereon, said potentiometer shaft extending through said mounting member, and wherein said means for fixedly securing said potentiometer housing comprises a resilient U-shaped wire having its closed end secured to said potentiometer housing by said nut and having its legs in resilient engagement with said motor housing which is disposed therebetween.

* * * * *